United States Patent [19]

Iams et al.

[11] Patent Number: 4,986,260

[45] Date of Patent: Jan. 22, 1991

[54] APPARATUS AND METHOD FOR PROVIDING CONTINUOUS PASSIVE MOTION TO THE SPINE

[75] Inventors: John F. Iams, Poway; Robson L. Splane, Jr., Granada Hills, both of Calif.

[73] Assignee: Superspine, Inc., Poway, Calif.

[21] Appl. No.: 121,534

[22] Filed: Nov. 16, 1987

Related U.S. Application Data

[63] Continuation of Ser. No. 871,319, Jun. 6, 1986, abandoned.

[51] Int. Cl.[5] ..... A61H 1/00

[52] U.S. Cl. ..... 128/24 R; 128/64

[58] Field of Search ..... 128/64, 66, 33, 24 R, 128/38–40

[56] References Cited

U.S. PATENT DOCUMENTS

| | | | |
|---|---|---|---|
| 1,772,310 | 8/1930 | Hart | 128/33 |
| 2,044,691 | 6/1936 | Hoflinger | 128/24 R |
| 2,245,909 | 6/1941 | Enfiajian | 128/33 |
| 2,361,242 | 10/1944 | Rosett | 128/33 |
| 2,684,672 | 7/1954 | Summerville | 128/33 |
| 2,943,620 | 7/1960 | Sibert | 128/33 |
| 2,998,817 | 9/1961 | Armstrong | 128/33 |
| 3,008,465 | 11/1961 | Gal | 128/33 |
| 3,199,124 | 8/1965 | Grant | 128/33 |
| 3,297,023 | 1/1967 | Foley | 128/33 |
| 3,446,203 | 5/1969 | Murray | 128/33 |
| 3,477,071 | 11/1969 | Emerson | 128/33 |
| 3,483,862 | 12/1969 | Takeuchi | 128/33 |
| 3,485,240 | 12/1969 | Fountain | 128/33 |
| 3,492,988 | 2/1970 | Maré | 128/33 |
| 3,595,223 | 7/1971 | Castagna | 128/33 |
| 3,613,671 | 10/1971 | Poor | 128/33 |

(List continued on next page.)

FOREIGN PATENT DOCUMENTS

| | | | |
|---|---|---|---|
| 498943 | 4/1976 | U.S.S.R. | 128/64 |
| 712085 | 1/1980 | U.S.S.R. | 128/24 R |

*Primary Examiner*—David A. Wiecking
*Assistant Examiner*—Huong Q. Pham
*Attorney, Agent, or Firm*—Spensley Horn Jubas & Lubitz

[57] ABSTRACT

A fluid operated device for applying continuous passive motion (CPM) to a person's spine is described, which comprises adjacent inflatable bladders adapted to be positioned transversely on opposite sides of a person's spine, against a fixed object and the person's body, a fluid conduit with a fluid control valve connecting the interiors of the bladders, a pump to force fluid intermittently into the first bladder and an exhaust to exhaust fluid from the second bladder, the intermittent pump rate and the flow restriction being selected so that the bladders fill and exhaust in sequence such that the peak pressure application to the body by the first bladder occurs before that of the second bladder.

Also described is a method for applying CPM to a person's spine. Broadly the method utilizes a bladder placed adjacent one side of the spine, then inflated and deflated intermittently to simulate multi-dimensional natural motion of the spine. Preferably the CPM is applied in a desired sequence, by positioning the person against at least two adjacent inflatable bladders aligned transversely on opposite sides of the person's spine, each bladder positioned against a fixed object and the person's body; forcing fluid under pressure intermittently into the first bladder to expand the first bladder against the person's body on one side of the spine; exhausting the fluid into the second bladder to expand the second bladder against the person's body on the other side of the spine; and exhausting fluid from the second bladder; with the peak pressure application to the body by the first bladder occuring before that of the second bladder and the CPM simulating multi-dimensional movement.

CPM can be applied to the lower back and pelvic region, the lumbar and thoracic spine or the cervical spine and the neck. The operating fluid may be a gas such as air or a liquid such as water and may be recycled. Multiple devices may be operated simultaneously. A person may use the system while seated or reclining.

26 Claims, 4 Drawing Sheets

U.S. PATENT DOCUMENTS

| | | | |
|---|---|---|---|
| 3,674,019 | 7/1972 | Grant | 128/33 |
| 3,678,520 | 7/1972 | Evans | 128/24 R |
| 3,760,801 | 9/1973 | Borgeas | 128/33 |
| 3,862,629 | 1/1975 | Rotta | 128/24 R |
| 3,976,056 | 8/1976 | Brawn | 128/24 R |
| 4,029,087 | 6/1977 | Dye | 128/24 R |
| 4,320,746 | 3/1982 | Arkans | 128/24 R |
| 4,375,217 | 3/1983 | Arkans | 128/24 R |
| 4,402,312 | 9/1983 | Villari | 128/24 R |
| 4,408,599 | 10/1983 | Mummert | 128/24 R |
| 4,583,522 | 4/1986 | Aronne | 128/24 R |

FIG. 2
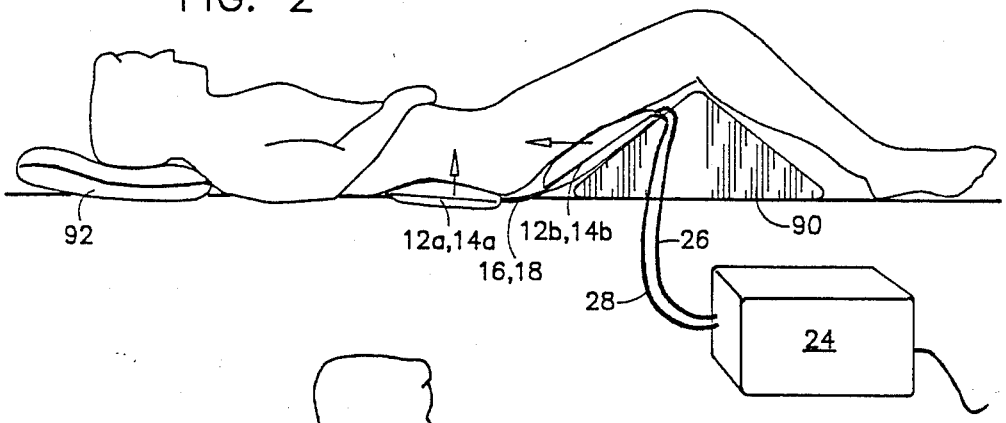
FIG. 3
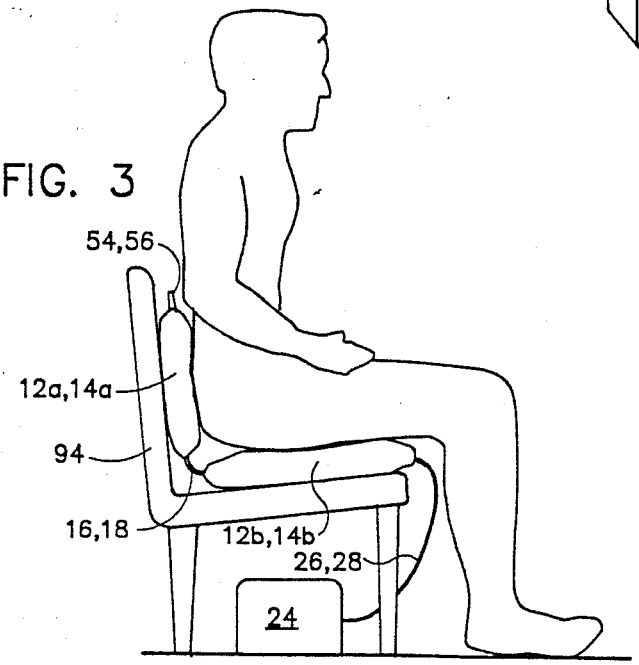
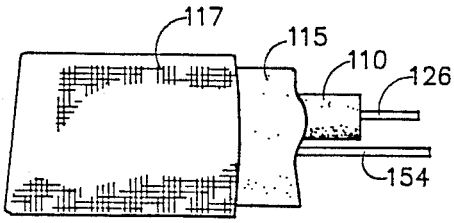
FIG. 4
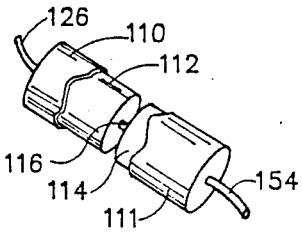
FIG. 5

APPARATUS AND METHOD FOR PROVIDING CONTINUOUS PASSIVE MOTION TO THE SPINE

This is a continuation of application Ser. No. 871,319, filed on June 6, 1986.

FIELD OF THE INVENTION

The invention herein relates to devices for providing motion to a person's spine and the associated muscles.

BACKGROUND OF THE INVENTION

A recent development in the fields of physical therapy and kinesiology has been the concept of "continuous passive motion" ("CPM"). The CPM concept involves the response of the body to gentle, essentially continuous motions induced by sources outside the body. CPM has been particularly significant in the treatment of trauma, where it has been found that the healing process is significantly improved and the recovery period shortened by use of CPM as compared to immobilization. Joint motion is preserved or restored sooner with less tendency for adhesion formation. CPM has also showed marked success in the treatment of muscle spasms and reduction of pain induced by such spasms.

Walking is known to be an effective exercise in many cases for providing motion to the thoracic and lumbar regions of the spine and the pelvis. Walking causes the pelvis to move relative to the lower back and can alleviate the symptoms of lower back muscles spasms. It is also an excellent exercise for healthy individuals, in that the walking keeps the spinal joints limber and helps prevent the onset of lower back problems Keeping the joints in good condition through walking can also lessen the severity of damage if the lower back is subsequently subjected to trauma.

Unfortunately, many people's occupations require them to remain seated or standing for extended time periods at a desk, work station, etc. Their opportunities to walk are therefore limited Other people are bed-ridden because of injury, illness or other infirmity and are unable to walk. These prolonged periods of sitting or reclining do not permit effective motion of the lower back, so that existing pain may persist or reduced joint and muscle mobility may develop.

The analogies between CPM and walking are evident. Light to moderate walking induces a gentle continuous motion to the lower back and pelvis. Its effects on speeding recovery from trauma are reflected in the wide-spread prescribing of walking by doctors for injured patients and also in the almost universal practice in hospitals of encouraging surgical patients to walk as soon as possible, sometimes within hours, after their surgery.

Other portions of the spine benefit from CPM. Motion of the neck is effective in reducing or eliminating pain from spasms in the neck muscles and cervical spine or to prevent the muscle and joint stiffness that a person often suffers upon awakening after a night's sleep when the head is kept in the same position for a long period. Similarly, motion of the mid body alleviates stiffness in the lumbar and thoracic spine caused by maintaining the body in a supine position, as during bed rest. While everyday activities usually provide sufficient motion to these parts of the body to avoid such pain, bed rest, sleeping or other factors may act to prevent a person from actively moving the affected parts of the spine and associated muscles.

It would therefore be advantageous to have a device which would allow users to obtain many of the beneficial effects of CPM for application to the spine and associated muscles, including the pelvis and neck, when such users cannot actually engage in the required amount of walking or other activities to provide the desired motions.

In the past devices have been described in which air cells have been sequentially inflated and deflated to support or apply pressure to portions of the body, notably the back and legs. Such devices have had two major deficiencies: they did not simulate normal body motions, but merely applied mechanical pressure to different body areas, and they operate unidirectionally, causing unidimensional movement only in the sagittal plane. Typical of the prior art devices are those shown in U.S. Pat. Nos. 2,719,986; 3,613,617; 3,653,083; 4,068,334; 4,197,837 and 4,396,010.

BRIEF SUMMARY OF INVENTION

The invention herein is a fluid operated device for applying continuous passive motion to a person's spine in a manner which simulates actual body motions, which comprises:

a. at least two adjacent inflatable bladders, adapted to be positioned transversely on opposite sides of a person's spine, one principal surface of each bladder adapted to be positioned in use against a fixed object and the other principal surface adapted to be positioned against the person's body, b. a fluid conduit connecting the interiors of the bladders, including a fluid control valve therein to restrict the rate of fluid passage from the first bladder into the interior of the second bladder;

c. pump means to force fluid under pressure intermittently from a source into the interior of the first bladder; and d. exhaust means to exhaust fluid from the interior of the second bladder;

the intermittent pump rate of the pump means and the degree of flow restriction of the fluid control valve being selected so that the first bladder fills with fluid and exhausts through the fluid conduit and valve into the second bladder and the second bladder fills and exhausts through the exhaust means in sequence such that the peak pressure application to the body by the first bladder occurs before the peak pressure application to the body by the second bladder.

The invention herein also comprises a method for applying continuous passive motion to a person's spine. In its broadest form, the method comprises positioning a person such that an inflatable bladder is positioned adjacent to the person's spine and spaced therefrom to one side laterally, one principal surface of the bladder positioned against a fixed object and the other principal surface positioned against the person's body; and forcing fluid under pressure intermittently into the bladder and exhausting the fluid therefrom to simulate through the continuous passive motion induced by the intermittent inflation and deflation of the bladder multi-dimensional motions of the spine which simulate actual spinal movements.

In a preferred embodiment, the method includes the use of a plurality of bladders, positioned on both lateral sides of the person's spine and application of continuous passive motion sequentially to the spine from laterally opposite sides of the spine, In this embodiment, the method comprises:

a. positioning said person against at least two adjacent inflatable bladders aligned transversely on opposite sides of the person's spine, one principal surface of each bladder positioned against a fixed object and the other principal surface positioned against the person's body;

b. forcing fluid under pressure intermittently from a source into the interior of the first bladder to expand the first bladder against the person's body on one side of the spine;

c. exhausting the fluid through a first conduit into the interior of the second bladder to deflate the first bladder and expand the second bladder against the person's body on the other side of the spine; and d. exhausting fluid from the second bladder; the peak pressure application to the body by the first bladder occurring before the peak pressure application to the body by the second bladder and the alternating pressure applications simulating actual body motions involving multi-dimensional movement of the spine.

In separate preferred embodiments the apparatus can be applied to the lower back and pelvic region, the lumbar and thoracic spine or the cervical spine and the neck. A lower back and pelvic apparatus comprises two pairs of bladders which act on the upper and lower portions of the buttocks and provide a simulated walking motion. A lumbar and thoracic spine apparatus comprises an elongated unit containing at least two bladders which imparts sequential pressure laterally across the mid body and causes a rolling motion around the spine. A neck and cervical spine apparatus is similar to the lumbar and thoracic spine apparatus and is configured to the contours of the neck, lower head and shoulders.

The apparatus is preferably designed to utilize air as the operating fluid. It may also be designed to utilize a gas other than air as the operating fluid or to use a liquid such as water. If the fluid is air it is preferred that the source be the surrounding ambient atmosphere and that the system exhaust to the surroundings. With other gases or liquids however it is preferred that the fluid be recycled.

BRIEF DESCRIPTION OF THE DRAWINGS

FIG. 2 is a schematic view of the apparatus of FIG. 1 being used by a person in a reclining position.

FIG. 3 is a schematic view of the apparatus of FIG. 1 being used by a person in a sitting position.

FIG. 4 is a schematic view of the bladder unit portion of an embodiment of the apparatus adapted to provide motion to the lumbar and thoracic portions of the spine and the mid body, also showing the optional outer facing or cover.

FIG. 5 is a perspective view, partially cut away, of the bladder component of the embodiment of FIG. 4.

DETAILED DESCRIPTION AND PREFERRED EMBODIMENTS

It is important to an understanding of this invention to recognize the multi-dimensional nature of most normal spinal movements. Walking, for instance, involves both movement in the sagittal plane (forward and backward) and rotational movement as the pelvis turns. Past devices have not had the ability to simulate such movements, being limited only to unidimensional motions which merely shift the body's position without simulating any natural body/spinal movements. While this has had some limited value, such as reducing the occurrence of decubitus ulcers in bedridden patients, these types of prior art devices have been ineffective in producing the beneficial CPM effects which arise from creating the simulated natural multi-dimentsional movements.

The apparatus of this invention and its various embodiments are best understood by reference to the drawings. The device comprises two principal components, a pump unit and a bladder unit, which are operably connected by fluid conduits. The configuration of the bladder unit determines the particular portion of the spine to which the device is adapted to be applied in actual use.

Figure 1:
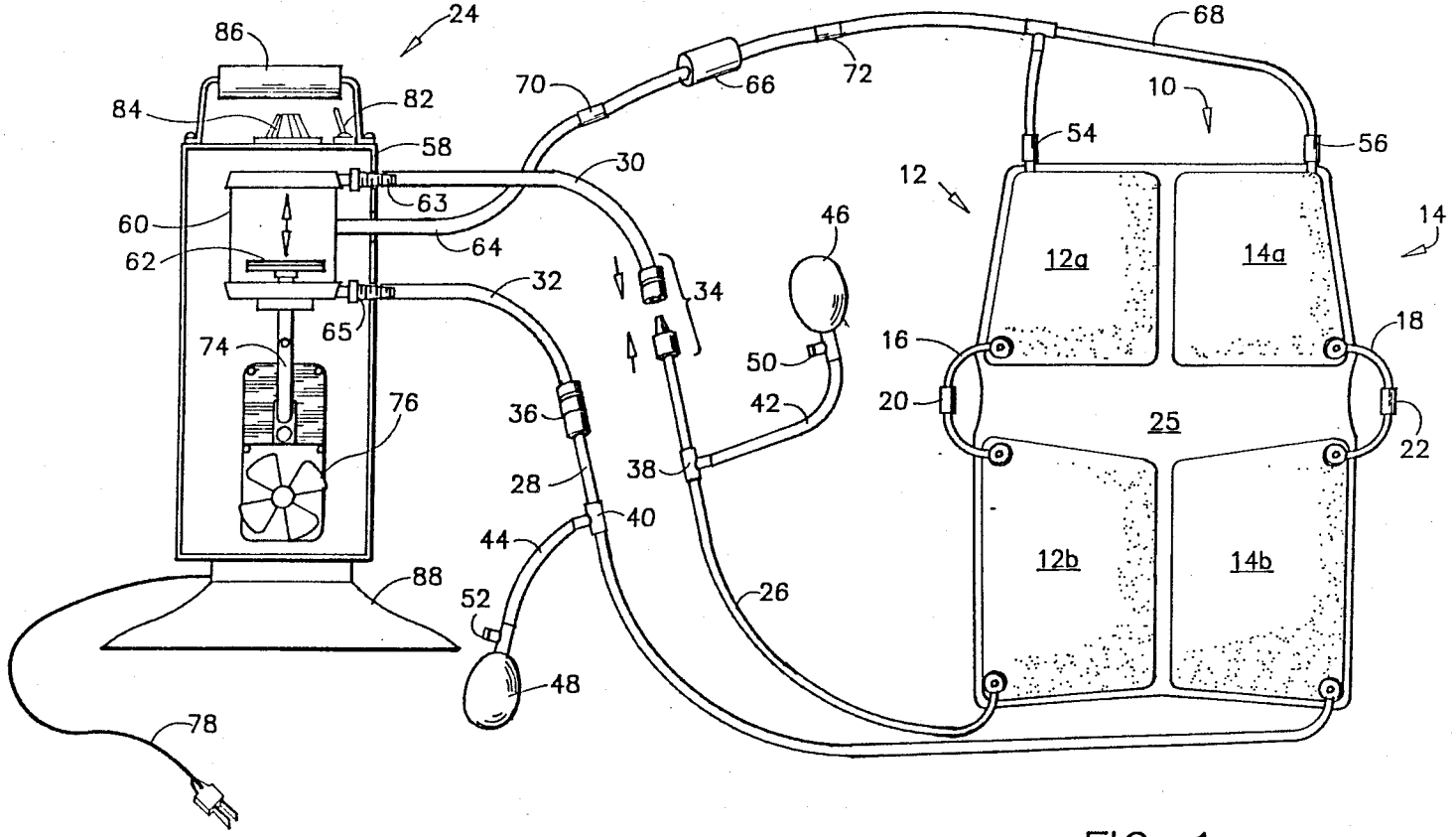
FIG. 1 is a schematic view of the apparatus in an embodiment adapted to provide motion to the lower back, lumbar and thoracic spine and pelvic region, and in which the pump portion is shown partially cut away.

Illustrated in FIGS. 1, 2 and 3 is the preferred embodiment for providing CPM to the lower back, lumbar spine and pelvic region.

The bladder unit 10 consists of four bladders arranged in two pairs. For simplicity in the following explanation, the bladder pairs in this embodiment will be referred to respectively as the left pair 12 and the right pair 14 as they appear in the figure. It will be understood from the following description that the bladder unit is laterally reversable, so that in use the unit can be aligned with either bladder pair on the left or right.

Within each pair there is what will be designated an upper bladder and a lower bladder. For the left pair the upper and lower bladders are designated respectively **12*a* and 12*b*; for the right hand pair they are 14*a* and 14*b*** respectively. The upper and lower bladders of each pair may or may not be reversable depending on the design of the particular unit. In the device as shown the lower bladders are longer than the upper bladders to extend farther around the lower part of the user's buttocks and upper thighs. To reverse this particular device with respect to the upper and lower bladders would reduce the ability of the device to provide optimum walking simulation. However, both bladders could be made the same size and the unit could then be readily reversed. As described below, it would of course be necessary to reverse the fluid supply conduits.

The bladders are conventional small fluid bladders made of a flexible rubber or plastic such as a vinyl. They are normally made of two flat sheets which are sealed together at the edges to form a fluid-tight interior. Inlet and exhaust conduits are formed through the edge seals so that the bladders can be filled and emptied. The outer surfaces of the bladders can simply be the sheet material itself or one or both of the bladder surfaces can be faced with a different sheet material (such as toweling, foam rubber, cotton cloth, absorbent cloth, textured sheeting or other material depending on the service application of the device) which may be adhered to the bladder sheet material surface. Alternatively, such different sheet material, in the form of an open-ended bag or sleeve, could be slipped over the bladder unit to provide the facing. For instance, a unit to be used in a hospital with bed-ridden patients where the bladder surface would rest directly against the person's skin might be covered with a soft cotton layer to provide comfort to the user. Similarly, a unit which was to be used a person sitting in a chair (as illustrated in FIG. 3) might have the surface faced with a textured rubber layer to prevent the bladders from sliding on the chair surface. Such materials may be washable or disposable. Many useful materials for the bladders themselves and any additional facing material will be easily identified by those skilled in the art based on the specific end use.

The upper and lower bladders of each pair are connected by fluid conduits 16 and 18 respectively, to provide passage of the operating fluid from the interior of the lower bladder to the interior of the upper bladder. In each conduit is a restricting valve or control means designated 20 or 22. This valve is designed and sized such that it allows the lower bladder to exhaust fluid at a controlled rate .so as to deflate slowly. Simultaneously the exhausting fluid inflates the upper bladder at the same rate. The design of the valve will determine whether the bladder unit 10 is reversable with respect to the upper and lower bladders of each pair, since most valves of this type are designed for fluid flow in only one direction. A two-way restricting valve, such as a simple orifice, would permit the unit to be reversed.

Joining the bladders is webbing 25. In the embodiment shown the webbing isolates all four bladders from one another. It is most convenient to form the webbing 25 simultaneously with the rest of bladder unit 10 by simply taking two large sheets of the vinyl or other bladder material and using heat, radio frequency, ultrasound or solvent welding to seal or adhesively join the inner surfaces of the two sheets together along the outer edges and in a cross shape to leave the four bladders as pockets 12*a*, 12*b*, 14*a* and 14*b* with the remainder sealed to prevent fluid passage It is possible that one could form fluid conduits 16 and 18 through the lateral span of webbing 25 to connect bladders 12*a* and 12*b* or 14*a* and 14*b* respectively, but that would require a complex installation to incorporate valves 20 and 22 into the conduits 16 and 18. It would also make it extremely difficult to replace the fluid conduits should they become perforated and begin to leak fluid. For these reasons it is preferred that the fluid conduits 16 and 18 containing valves 20 and 22 be mounted externally as shown and that the transverse portion of webbing 25 be completely sealed and fluid impermeable.

The longitudinal portion of webbing 25 lying respectively between the two upper bladders and the two lower bladders must be sealed to be completely fluid impermeable so that there is no lateral transfer of fluid between the left and right halves of the unit. The longitudinal portion of the webbing 25 is preferably formed with a longitudinal seam so that the bladder unit 10 can be folded in half to be easily carried. The lateral portion may also be seamed to be folded, but that is less preferred unless provisions are made for flexing of conduits 16 and 18.

The bladder unit 10 is operably connected to the pump unit 24 by fluid conduits 26 and 28 which are coupled to conduits 30 and 32 respectively through quick disconnect couplings 34 and 36 (coupling 34 being shown in the uncoupled position). Couplings 34 and 36 are preferably of the type which close the fluid line to the bladders when the coupling is disconnected. Normally that portion of coupling 34 or 36 attached to conduit 30 or 32 remains open at all times. This permits the pump unit to be run with one conduit connected and the other disconnected, with no loss of fluid. The other portion, attached to conduit 26 or 28, closes automatically upon disconnection of the coupling 34 or 36.

Within each conduit 26 and 28 is a tee connection 38 or 40 to which is connected a second conduit 42 or 44 leading to flexible bulb valve 46 or 48. These in turn are connected to valves 50 or 52 respectively which are preferably small exhaust valves. The bulb valve can thus be used to inflate the bladder initially with air and the exhaust valve can be used to exhaust the bladder.

In one embodiment, exhaust valves 54 and 56 are incorporated in bladders 12*a* and 14*a* to exhaust the upper bladder of each pair during the normal operation of the unit. Each valve is designed to have a fluid flow rate complimentary to that of the restraining valves 20 and 22 so that the upper bladder inflates an exhaust at a rate coordinated with the inflation and deflation of the lower bladder in each pair. In some embodiments involving recycle of the fluid, the exhaust valves are not needed, for the exhaust is provided by the pump, as will be described below.

FIG. 2 shows the unit as used by a person in a reclining position, in this case lying on a flat, hard surface such as a floor. Each of the bladders to be operable of course must bear on one side against a fixed object. This allows the bladder to expand against the person's body on the other side of the bladder. In FIG. 2 the upper bladders 12*a* and 14*a* rest directly on the floor with the person's lower back lying against the upper bladders. The lower bladders 12*b* and 14*b* rest underneath the person's lower buttocks and upper thighs. In simulating the walking motion it is preferable that the user's legs be flexed and knees elevated as shown in FIG. 2; this is also a more comfortable position for the user than having the legs fully extended and the thighs against the floor. Since the lower bladders 12*b* and 14*b* cannot bear against the floor in this position the user places the lower bladders 12*b* and 14*b* against wedge 90 which extends under the user's knees. Wedge 90 is made of some type of firm material, preferably a light-weight foam. The surface is covered with any suitable fabric, plastic or other facing, preferably with some degree of texture to the facing surface so that the lower bladders do not tend to slip.

FIG. 2 also shows an ordinary pillow 92 under the user's head. Use of this pillow is optional and is solely for the user's comfort. It is not a part of the present invention.

FIG. 3 is analogous to FIG. 2 except that it shows a person using the present device while seated in chair 94. In this case the auxiliary wedge 90 is not needed since both the upper and lower bladders bear against the back or seat of the chair. The device as shown in FIG. 3 may also be used in a similar manner in an automobile seat to relieve the problems encountered by prolonged periods of driving when the automobile driver or passenger has little opportunity to change positions. In this case the pump unit would be equipped with a motor 76 which could be powered from the car's electrical system either through some type of adapter or by having line cord 78 capable of being plugged into the car's cigarette lighter or otherwise connected to the electrical system.

Figure 6:
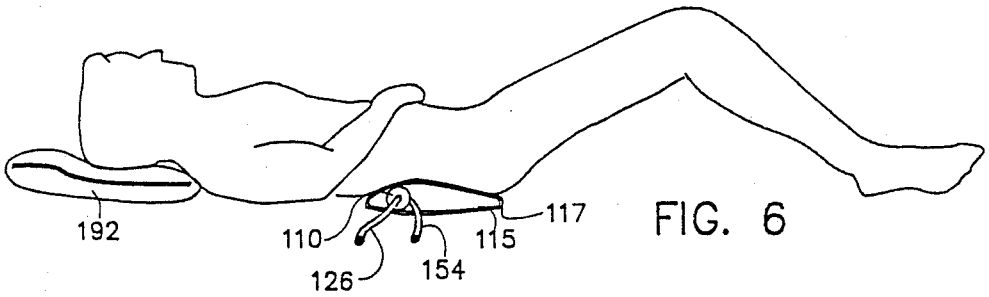
FIG. 6 is a schematic view of the apparatus of FIG. 4 being used by a person in a supine position.

Illustrated in FIGS. 4, 5 and 6 is the bladder unit of a preferred embodiment of the apparatus adapted to provide CPM to the mid and lower back and the thoracic and lumbar portions of the spine, by imparting sequential pressure laterally across the body. The Figures show only the bladder unit since the pump unit will be the same as that illustrated in FIGS. 1 and 9 for the pelvic/lower back embodiment. The bladder unit 110 is composed of a elongated container 111 (shown here as generally cylindrical) which has therein at least two internal bladders 112 and 114 aligned axially of the container 111. The bladders 112 and 114 are joined by fluid conduit 116 which contains a valve (not shown) analogous to valve 20 or 22 in FIG. 1. The first bladder is supplied with fluid through conduit 126 and the fluid exhaust from the last bladder through conduit 154. (The fluid source and exhaust paths are as shown in FIG. 1 connected to conduits 26 and 54 respectively.) A foam insert 115 is provided to create a wedge shape for the bladder unit and make its use more comfortable for the user. The insert is optional, however, and the bladder unit 110 may be used alone if desired Also shown in FIG. 4 is optional facing cover 117, in this case in the form of an open ended bag or sleeve, which is slipped over the unit to provide a cloth surface for contact with the user's skin. FIG. 6 also shows optional pillow 192 used to support the user's head.

Figure 7:
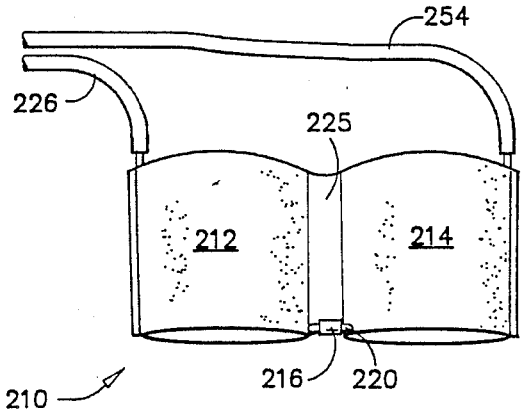
FIG. 7 is a schematic view, partially cut away, of the bladder unit portion of an embodiment of the apparatus adapted to provide motion to the neck and cervical spine.
Figure 8:
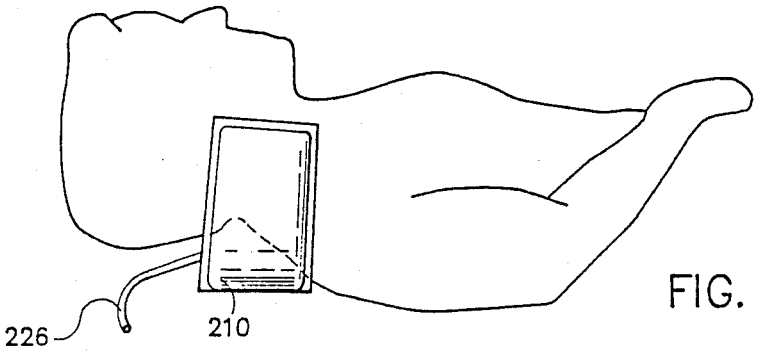
FIG. 8 is a schematic view of the apparatus of FIG. 6 being used by a person in a supine position.

FIGS. 7 and 8 illustrate a preferred embodiment of the apparatus adapted to provide CPM to the user's neck and cervical spine. The bladder unit 210 is configured to fit comfortably around the back of the user's neck at the base of the skull with two bladders 212 and 214 which are connected by webbing 225. Fluid flows from bladder 212 to bladder 214 through fluid conduit 216 containing valve 220. Fluid enters through conduit 226 and exhausts through conduit 254. All of these components function in the manner described for the analogous components in FIG. 1.

It will be recognized that for most of the embodiments more than two bladders may be used, although usually two will be the preferred number (except in the lower back/pelvic unit where two pairs of bladders are required). The neck unit or the thoracic/lumbar unit may contain several bladders arranged in an axial sequence and which inflate and deflate in turn. It is preferred for balance that even numbers of bladders be used. It is also preferred that, in order to provide for smooth motion, the first bladder in the sequence not begin to inflate until the last bladder has begun to deflate.

In further embodiments (not shown), especially of the neck and/or mid-back/thoracic units, the restriction valve 20 or 22 between the adjacent bladders may be equipped with a full shut-off capability, so that the connection between the bladders may be closed to fluid passage. The fluid is then contained in the first bladder, which is intermittently filled and exhausted by the pump action, as explained in more detail below. This allows the unit to be used to provide CPM motion to the spine from only one side of the spine rather than alternately from opposite sides of the spine. This provides for simulating motions which concentrate on only one side of the body. For instance, with the neck unit, these embodiments permit the neck to be rotated and the neck muscles extended only to one side, rather than back and forth to both sides. This may be quite desirable in some forms of physical exercise and/or physical therapy. It will be recognized that an analogous effect is obtained with the lower back/pelvic units by using only one pair of bladders, i.e., pair **12*a*/12*b* or pair 14*a*/14*b***.

Figure 9:
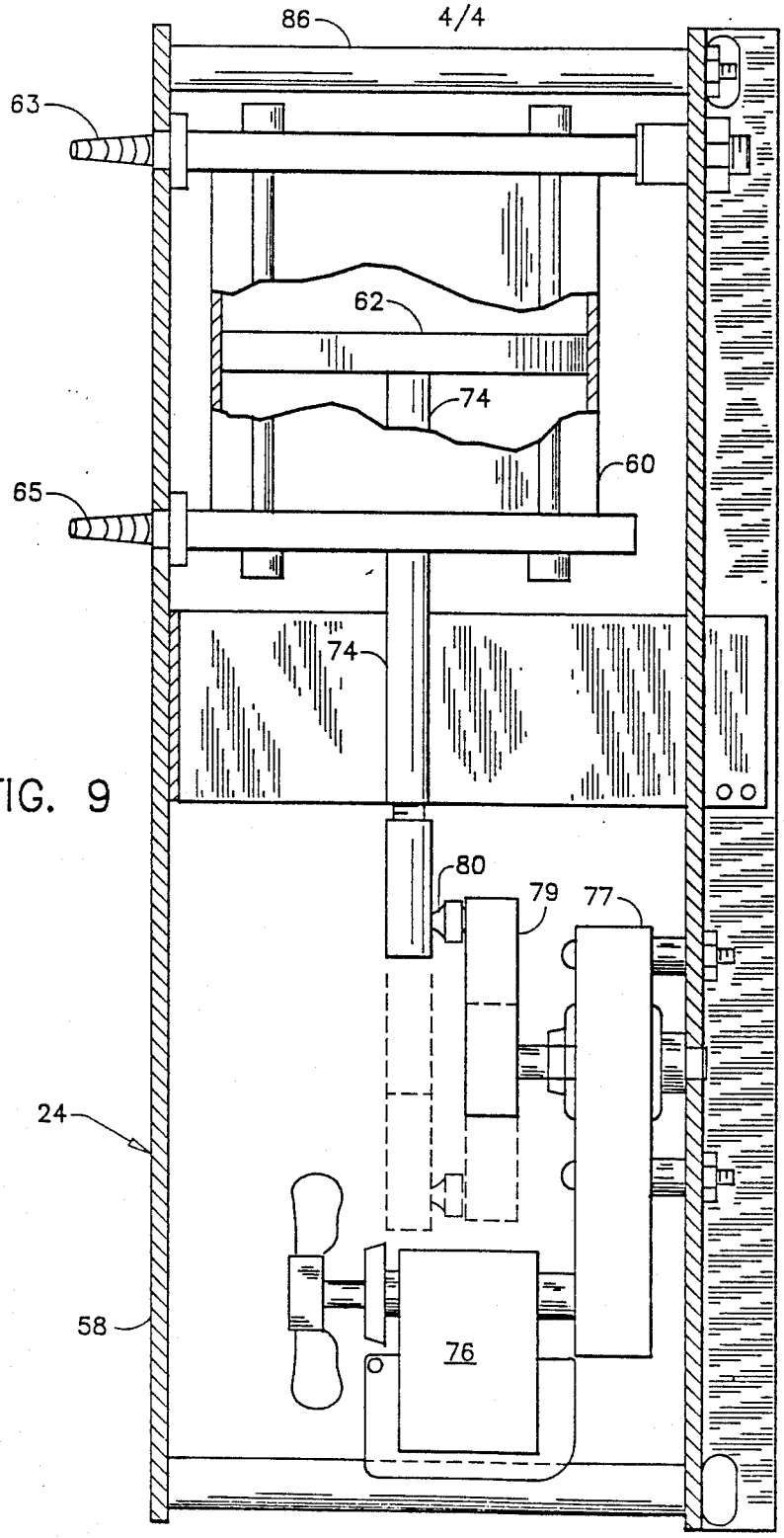
FIG. 9 is a side view, partially cut away, of a typical pump component of this device.

The pump component shown in FIGS. 1 and 9 is the same for all of the different embodiments, and its conduits will couple to the mating conduits on any of the bladder units. If multiple conduit pairs from the pump are used and the pump capacity is adequate, more than one bladder unit can be operated from the same pump unit simultaneously. Thus one person could, for instance,, have both neck and lower back CPM at the same time. Similarly, two or more people could receive CPM from different bladder units simultaneously.

The pump unit 24 may be based on a variety of different fluid feed devices, some of which also serve as the exhaust means. One may use, for instance, a motor driven single or double acting piston pump or an "aquarium-type" pump. In the embodiment illustrated in FIGS. 1 and 9, pump unit 24 consists of a case 58 which contains cylinder 60 having a double acting piston 62 inside. Fluid conduits 30 and 32 are connected respectively to nipples 63 and 65 at the opposite ends of cylinder 60 so that as piston 62 moves back and forth within cylinder 60 fluid is alternately pumped through conduits 30 and 32. The resulting intermittent fluid flow thus causes the bladder unit halves 12 and 14 to operate in sequence.

Fluid is supplied to cylinder 62 in any of several ways. In a simple embodiment (not shown) using a single acting cylinder and only outlet conduct 30, nipples 63 and 65 could contain or be in line with one way valves, so that the valve with nipple 63 would be an outlet valve and that with nipple 65 would be an inlet valve. The latter would be connected to a fluid source (open to the atmosphere if the fluid were air, usually). In a preferred embodiment, illustrated by part of FIG. 1, the bladders **12*a* and 14*a* would be sealed at the top and exhaust valves 54 and 56 would not be present (nor would the recycle components 64–70). Using a double acting piston 60, alternate strokes would first force fluid into the bladders 12*a*/12*b* or 14*a*/14*b* and then on the reverse stroke create a suction which would exhaust each bladder pair. This is facilitated if valves 20 and 22 have restricted flow only in the inlet direction and full flow in the outlet (suction) direction. Flapper valves or sloped ball valves can accomplish this. A more complex recycle system is also shown in FIG. 1, in which a double acting piston having outlet valves through nipples 63 and 65 and an inlet valve through conduct 64 are used. Fluid is recycled through the system by connecting return line 68 to outlet valves 54 and 56 and having return line 68 exhaust into conduit 64 either directly or through reservoir 66. Quick disconnect couplings 70 and 72 may be used to allow the components to be separated. It will be evident that these variations may be used in different combinations, as where conduct 64 is open to the atmosphere as are exhaust valves 54 and 56** if recycle is not desired.

The operating fluid is preferably air, but may be another gas, for instance an inert gas such as nitrogen or argon. Alternatively it may a liquid such as water.

Piston 62 is operated through piston rod 74 by motor 76, which is typically a continuous duty variable speed motor. Typical operating speed of the piston is 6 strokes per minute. Power cord 78 is used to provide electrical power to motor 76. Motor 76 operates through a reduction gear set 77, eccentric or crank 79 and connecting rod 80 to convert the rotary motion of the motor to reciprocating motion and to increase the motor's torque to drive piston rod 74. Switch 82 is cut into power cord 78 (through wires not shown) to serve as an off/on switch for the unit. If the motor is a variable speed motor rheostat 84 can also be incorporated into the electrical circuitry to allow the motor speed and thus the reciprocating rate of piston 62 to be varied. Handle 86 mounted on one end pump unit 24 enables the unit to be easily carried, while base 88 at the other end of the pump unit 24 allow it to conveniently stand on the floor or other flat surface adjacent to the point of use of the system.

The operation of the device may be readily described. The bladder unit 10 is positioned in a chair or automobile seat, on the floor, on a bed or in any other convenient location with a relatively rigid backing and on which the user can sit or recline (either horizontally or at an incline). The location chosen should be such that the user does not have to make a conscious effort to stay positioned on the device. The pump unit 24 is then connected to an appropriate electrical source and to a fluid source. As pump 76 operates it drives piston 62 at the desired rate of speed. Typically the cylinder will have a capacity of approximately 33 $in^3$ (540 $cm^3$). If the motor is run at a typical rate of 6 rpm the pump then delivers 200 $in^3$/min (3.2 l/min) to the first bladder (or, in the lower back/lumbar embodiment, to the lower bladder of each lateral half of the bladder unit) so that the first bladder is filled and exhausted 6 times per minute or approximately once every 10 seconds. The first bladder then exhausts into the second bladder through the flow control valve, so that the second bladder inflates as the first bladder deflates. Thereafter the second bladder deflates though the exhaust valve at the end of the selected time cycle. At that point the pump delivers its next quantity of fluid and the cycle continues. Use of 3/16 or ¼ in. (5 or 6 mm) tubing conduit provides adequate fluid flow for the air to fill and exhaust the bladders sequentially and provide the gentle continuous motion desired.

The motor speed and fluid flow will be preferably be variable so that the user can adjust the flow rate and induced motion to that which is most comfortable or which is prescribed by a physician or therapist. Normally the rate will be such that the bladders will inflate and deflate from 1 to 15 times per minute. Slower rates will not usually provide adequate CPM spinal and muscle movement, while faster motions will be distracting and uncomfortable to the user, particularly if the person is seated as in FIG. 3 and trying to drive or do manual work while the device operates. The actual fluid flow rate will depend upon the size of the bladders and the capacity of the pump. Adjustments will also be made in flow rate for the bodily weight of the particular person using each system.

It will be evident that there are numerous embodiments, which while not described above, are clearly within the scope and spirit of the invention. The above description is therefore intended to be exemplary only and the invention is to be limited solely by the appended claims.

We claim:

1. A fluid operated device for applying continuous passive motion to a person's spine in a manner which simulates natural motions of spinal joints, which device comprises:

a. at least two inflatable bladders to be positioned substantially in a plane on opposite sides of a person's spine, one principal surface of each bladder adapted to be positioned in use against a fixed object and the other prinicipal surface adapted to be positioned against an associated area of the person's body, each of said bladders being off sufficient (i) area, (ii) deflated contracted volume and inflated distended volume so that successive pressurizations and depressurizations of each bladder will provide multi-dimensional movement of the spinal joints;

b. fluid conduit and control means for connecting the interiors of said bladders and for allowing fluid from the first bladder to flow into the interior of the second bladder at a continuous, controlled rate during inflation of the first bladder;

c. pump means to force fluid under pressure intermittently from a source of fluid into said interior of said first bladder; and d. exhaust means to exhaust fluid from said interior of said second bladder;

the pump rate of said pump means and the rate of fluid flow through the fluid conduit and control means being selected so that as said first bladder is inflated, the second bladder is simultaneously being inflated at a lesser rate and as the first bladder begins to deflate, the second bladder continues to inflate, the first and second bladders filling and exhausting in sequence such that the peak displacement to the associated area of the person's body of said first bladder occurs before the peak displacement tot he associated area of the body by said second bladder, the sequential filling and emptying of said bladders inducing multi-dimensional movement of the spinal joints of the section of the spine adjacent to the bladders.

2. Apparatus as in claim 1 adapted to utilize a gas as the operating fluid.

3. Apparatus as in claim 2 wherein said gas is air or an inert gas.

4. Apparatus as in claim 2 wherein said gas is air.

5. Apparatus as in claim 1 adapted to utilize a liquid as the operating fluid.

6. Apparatus as in claim 5 wherein said liquid is water.

7. Apparatus as in claim 1 further comprising means to recycle the operating fluid from said exhaust means to said pump means.

8. Apparatus as in claim 1 wherein said fluid control valve includes means to close said valve to fluid flow, and said apparatus further includes means to exhaust said fluid from said first bladder.

9. A fluid operated device for applying continuous passive motion to a person's spine in a manner which simulates natural motions of spinal joints, which device comprises:

a. two pairs of inflatable bladders, each pair dimensioned to be aligned parallel to distinct areas of the person's spine, one principal surface of each bladder adapted to be positioned in use against a fixed object and the other prinicipal surface adapted to be positioned against an associated area of the person's body, with the first bladder of each pair being of sufficient area and appropriate position to displace one of the person's buttocks below the hip joint when inflated and the second bladder of each pair being of sufficient area and appropriate position to displace the person's lower back above the hip joint when inflated;

b. a pair of fluid conduit and control means, each respectively connecting the interiors of said bladders of each pair for allowing fluid to flow from the first bladders to the second bladders;

c. pump means to force fluid under pressure intermittently from a source of fluid into the interiors of the first bladders of each pair; and d. exhaust means to exhaust fluid from the interiors of the second bladders of each pair;

the pump rate of said pump means and the rate of fluid flow through the fluid conduit and control means being selected so that each said first bladder sequentially fills with fluid and exhausts through said fluid conduit and control means into each said second bladder and as each first bladder of the pair of bladders is inflated, each second bladder of the pair of bladders is simultaneously being inflated at a lesser rate, and as each first bladder begins to deflate, the second bladder continues to inflate, the first and second bladders of each pair of bladders filling and exhausting in sequence such that the peak displacement of the buttock portion below the hip joint occurs before the peak displacement of the lower back portion above the hip joint, wherein the successive displacements of the body areas upon either side of the spine above and below the hip joint induce a natural, multi-dimensional movement in the spinal joints.

10. Apparatus as in claim 9 further comprising means incorporating both pairs of bladders into a single unit.

11. Apparatus as in claim 10 wherein said means comprises a fluid impermeable webbing attached to said bladders.

12. Apparatus as in claim 9 wherein in each pair of bladders one bladder is larger than the other.

13. Apparatus as in claim 9 wherein said pump means comprises a double acting piston within a cylinder, said cylinder having at each end thereon a fluid connection to said first bladder in each of said pairs with the fluid discharged alternately from each end of said cylinder by action of said piston and passing alternately to each of said pairs of bladders.

14. Apparatus as in claim 1 wherein said pump means is driven by an electric motor.

15. Apparatus as in claim 14 wherein said electric motor may be run from an automotive electrical system.

16. Apparatus as in claim 1 wherein said pump has a pumping rate of from 1 to 15 cycles per minute.

17. Apparatus as in claim 1 wherein said exhaust means comprises an exhaust valve in said second bladder.

18. Apparatus as in claim 1 wherein said exhaust means comprises the inlet stroke of said pump.

19. A continuous passive motion device for effecting a natural, rotational movement of a person's joints, comprising:

a. at least a first and a second inflatable bladder to be positioned substantially in a plane on opposing sides of a person's joint beneath groups of muscles associated with the joint, the bladders being sized to displace the groups of muscles when inflated;

b. fluid conduit and control means for connecting the bladders and for allowing fluid from the first bladder to flow into the second bladder at a continuous, controlled rate, whereby as the first bladder is inflated, the second bladder is simultaneously being inflated at a lesser rate and as the first bladder begins to deflate, the second bladder continues to inflate.

c. means for sequentially inflating the first bladder and deflating the second bladder, whereby the muscles of the groups of muscles are displaced and rotational movement of the joint relative to adjacent joints is effected.

20. A continuous passive motion device for effecting multi-dimensional movement of a person's spinal joints, comprising:

a. at least four inflatable bladders, a first and a second of the bladders placed side by side so as to be positioned longitudinally spaced beneath a portion of a person's body adjacent one side of the spine and a third and a fourth bladder placed side by side so as to be positioned longitudinally spaced beneath a portion of the person's body on the opposing side of the section of the spine; and b. means for inflating and deflating in sequence the first bladder, the second bladder, the third bladder and finally the fourth bladder, to impart rotational motion of spinal joints about the section of the spine adjacent which the bladder is positioned and motion along the sagittal plane of the spinal joints associated with the portion of the spine adjacent to the bladders.

21. The device of claim 20, wherein the first bladder is positioned beneath the person's left buttock below the hip joint and the third bladder is positioned beneath the person's right buttock below the hip joint, the first and third bladders being sized to displace the respective buttock when inflated, and wherein the second bladder is positioned beneath the muscles of the lower back above the hip joint on the left side of the person's body and the fourth bladder is positioned beneath the corresponding muscles on the right side of the body, the second and fourth bladders being sized to displace the muscles beneath which they are positioned upon being inflated whereby when the bladders are sequentially inflated and deflated, sequentially displacing the buttocks and lower back muscles, motion substantially identical to motion produced during walking is imparted to the lumbar region of the spine.

22. The device of claim 21, wherein the means for inflating and deflating comprises pump means, exhaust means and a plurality of fluid conduit and control means, a first fluid conduit and control means internally connecting the first and second bladders and a second fluid conduit and control means internally connecting the third and fourth bladders and wherein, in sequence, the first bladder is inflated by the pump means and deflated by the first fluid conduit and control means whereby the second bladder is inflated, then the second bladder is deflated by the exhaust means and the third bladder is inflated by the pump means and deflated by the fluid conduit and control means whereby the fourth bladder is inflated and finally the fourth bladder is deflated by the exhaust means, and the sequence is repeated.

23. Apparatus as in claim 1 wherein said at least two bladders are in axial sequence and adapted to be aligned laterally across the person's body, with at least one bladder on each transverse side of the person's spine.

24. Apparatus as in claim 23 wherein said bladders are contained in an elongated container.

25. Apparatus as in claim 24 wherein said elongated container is configured to conform to the person's body contours at the point of application.

26. Apparatus as in claim 25 wherein said container conforms to the contours of the person's neck.

* * * * *